US010667592B2

(12) United States Patent
Gayton

(10) Patent No.: US 10,667,592 B2
(45) Date of Patent: Jun. 2, 2020

(54) INTEGRATED AT LEAST TWO COMPONENT SYSTEM AND METHOD

(71) Applicant: Karen Gayton, Gainesville, GA (US)

(72) Inventor: Karen Gayton, Gainesville, GA (US)

( * ) Notice: Subject to any disclaimer, the term of this patent is extended or adjusted under 35 U.S.C. 154(b) by 0 days.

(21) Appl. No.: 15/186,473

(22) Filed: Jun. 18, 2016

(65) Prior Publication Data

US 2019/0116954 A1 Apr. 25, 2019

(51) Int. Cl.

| | |
|---|---|
| ***B43K 5/14*** | (2006.01) |
| ***A45D 19/02*** | (2006.01) |
| ***A45D 34/04*** | (2006.01) |
| ***B01F 15/00*** | (2006.01) |
| ***B01F 15/02*** | (2006.01) |
| ***B01F 13/00*** | (2006.01) |
| ***B01F 11/00*** | (2006.01) |
| *A45D 19/00* | (2006.01) |
| *A45D 34/00* | (2006.01) |

(52) U.S. Cl.

CPC ..... *A45D 19/02* (2013.01); *A45D 34/042* (2013.01); *B01F 11/0065* (2013.01); *B01F 13/002* (2013.01); *B01F 13/0022* (2013.01); *B01F 13/0052* (2013.01); *B01F 15/0087* (2013.01); *B01F 15/00974* (2013.01); *B01F 15/0206* (2013.01); *B01F 15/029* (2013.01); *B01F 15/0224* (2013.01); *A45D 2019/0066* (2013.01); *A45D 2034/005* (2013.01); *A45D 2200/054* (2013.01); *A45D 2200/058* (2013.01); *A45D 2200/25* (2013.01); *B01F 2215/0031* (2013.01)

(58) Field of Classification Search

CPC ..... A45D 2200/1045; A45D 19/02; A45D 2019/02; A45D 2019/0066; B01F 15/0087; B01F 15/0206; B01F 15/00974; B01F 13/0052

USPC ..... 401/133, 134

See application file for complete search history.

(56) References Cited

U.S. PATENT DOCUMENTS

| | | | | |
|---|---|---|---|---|
| 7,631,645 | B2 * | 12/2009 | Gayton | A45D 19/02 132/112 |
| 2010/0202246 | A1 * | 8/2010 | Huck | B01F 13/0052 366/185 |
| 2017/0056904 | A1 * | 3/2017 | Brugger | B65D 83/0061 |
| 2018/0132999 | A1 * | 5/2018 | Perouse | A61F 2/2433 |
| 2018/0256233 | A1 * | 9/2018 | Vogt | A61B 17/8822 |

* cited by examiner

*Primary Examiner* — Jennifer C Chiang

(74) *Attorney, Agent, or Firm* — Lainie E. Parker; Richard M. Blank

(57) ABSTRACT

An integrated at least two component mixing and delivery system and method for creating a new mixture from a first component contained within a first enclosure and a second component contained within a second enclosure that is contained within the first enclosure and, via a series of operations that mix the two components and enable the application of through an applicator tip the placement of the new mixture on at least one surface or a portion thereof.

18 Claims, 4 Drawing Sheets

INTEGRATED AT LEAST TWO COMPONENT SYSTEM AND METHOD

FIELD OF INVENTION

The present invention can be used in many fields. However, the current embodiments generally are in the field of coloring hair, and more particularly is in the field of portable, disposable devices for coloring hair re-growth, particularly hair roots, and/or adding highlights and streaks, and methods for coloring hair using such devices.

SUMMARY OF INVENTION

The invention is an integrated at least two Component system which creates at least one New Mixture and then enables the application of said at least one New Mixture onto at least one Surface.

This system contains at least one first Component in a first sealed container and at least one second Component in a second sealed container that is contained within the first Component in the first sealed container. This system enables the mixing of these Components to produce a New Mixture, and then enables the application of this New Mixture to be applied on at least one Surface, and is accomplished via several embodiments described herein.

In at least one embodiment an integrated at least two Component system for applying a substance to at least one Surface is comprised of: (A) an outer container made from a flexible material and having a closed bottom and sides and an open top, and the outer container contains at least one first Component; (B) at least one breakable ampoule can be contained within the outer container, and the at least one breakable Ampoule can contain at least one second Component, and whereupon the rupturing, breaking, crushing, and/or squeezing of at least one breakable Ampoule can allow the mixing of at least one first Component with at least one second Component to form a New Mixture; (C) a rotatable applicator valve assembly comprising: a) an applicator subassembly for applying, the New Mixture comprising: i) an applicator nozzle outer first end containing an applicator tip enabling the New Mixture to pass from the interior of the rotatable applicator valve assembly through the applicator tip to the exterior ambient; ii) an applicator nozzle inner second end containing a rotatable first valve cylindrical plate containing a rotatable first valve cylindrical plate hole; b) a stationary second valve cylindrical plate attached to the open top while permitting rotation of the applicator subassembly, and the stationary second valve cylindrical plate contains a stationary second valve cylindrical plate hole, and the rotatable first valve cylindrical plate is capable of rotating when the applicator subassembly is rotated, and the rotatable first valve cylindrical plate hole is capable of aligning at a first aligning angle with the stationary second valve cylindrical plate hole producing a valve open position and allowing the New Mixture to pass from the interior of the outer container into the interior of the rotatable applicator valve assembly when external pressure and/or manual force is applied to the outer container and/or when pressure increases sufficiently within the interior of the outer container, and when the rotatable first valve cylindrical plate hole is not aligned with the stationary second valve cylindrical plate hole the New Mixture is blocked in at least one closed position and prevented from passing from the interior of the outer container into the interior of the rotatable applicator valve assembly; (D) a filter contained within the outer container or the rotatable applicator and valve assembly, and the filter is capable of preventing particulate material from passing from the outer container into the rotatable applicator valve assembly.

The filter can be at least one of in whole or in part made from foam, rubber, plastic, metal, screening, mesh, ceramic, cotton, fiberous material.

The applicator tip can be at least one of a brush, foam, sponge, a comb, hose, a nozzle, a membrane permitting material transfer and/or diffusion, a tube or series of tubes.

The invention can also have at least one mixing ball and/or at least one other object or solid object within the interior of the outer container.

The invention can include at least one additional product and/or hair care product contained in the outer container and/or in at least one ampoule.

Applied external pressure and/or manual force and/or mixing can be generated by the act of squeezing, grasping, shaking, and/or other applied pressure, force, mixing the outer container using at least one hand, finger, or other body part alone or in connection with use of at least one tool or other physical object.

The opening at top of the at least one outer container may contain integral screw threads capable of mating with complimentary screw threads on attachable devices including but not limited to an attachable and removable rotatable applicator valve assembly to enable the rotatable applicator valve to attach to the open top.

The valve in at least one open position and/or at least one closed position can be designated and/or defined by at least one mechanical detent produced at the mating Surfaces of the rotatable first valve cylindrical plate and the stationary second valve cylindrical plate.

The Ampoule may further comprise of at least one of a breakable sealed glass container, a housing, at least one breakaway membrane, at least one puncturing and/or piercing edge and/or tooth to puncture at least one breakaway membrane when external pressure and/or manual force is applied to at least one location to the outer container.

One method for applying a New Mixture to at least one Surface is comprised of the following steps: A) squeezing the outer container to break an Ampoule contained within the outer container; B) squeezing and massaging the outer container to mix the second Component contained within the Ampoule with the first Component contained within the outer container to create the New Mixture; C) rotating a rotatable applicator valve assembly from at least one closed position to an open position to allow the New Mixture to flow out of the rotatable applicator valve assembly into the applicator tip contained within the rotatable applicator valve assembly. D) squeezing the outer container to force the New Mixture out of the outer container into the applicator tip, and applying the New Mixture to a chosen Surface or hair area; E) if there is any New Mixture remaining in the outer container, the rotatable applicator valve assembly can be rotated from the open position to at least one closed position to prevent any New Mixture from exiting and/or leaking out of the rotatable applicator valve assembly.

In at least one second embodiment the filter(s) are secured around the Ampoule(s). The invention can be an integrated at least two Component system for applying a substance to at least one Surface comprising: (A) an outer container made from a flexible material and having a closed bottom and sides and an open top, and the outer container can contain at least one first Component; (B) at least one breakable Ampoule contained within the outer container, wherein at least one breakable Ampoule contains at least one second Component, whereupon the rupturing and/or breaking and/ or crushing and/or squeezing of at least one breakable Ampoule allows mixing of at least one first Component with at least one second Component to form at least one New Mixture; (C) a rotatable applicator valve assembly comprising: a) an applicator subassembly for applying the New Mixture comprising: i) an applicator nozzle outer first end containing an applicator tip enabling the New Mixture to pass from the interior of the rotatable applicator valve assembly through the applicator tip to the exterior ambient; ii) an applicator nozzle inner second end containing a rotatable first valve cylindrical plate containing a rotatable first valve cylindrical plate hole; b) a stationary second valve cylindrical plate attached to the open top while permitting rotation of the applicator subassembly, and the stationary second valve cylindrical plate contains a stationary second valve cylindrical plate hole, and the rotatable first valve cylindrical plate being capable of rotating when the applicator subassembly is rotated, and the rotatable first valve cylindrical plate hole is capable of aligning at a first angle with the stationary second valve cylindrical plate hole to produce a valve open position and thus allowing the New Mixture to pass from the interior of the outer container into the interior of the rotatable applicator valve assembly when external pressure and/or manual force is applied to the outer container and/or when pressure increases sufficiently within the interior of the outer container, and when the rotatable first valve cylindrical plate hole is not aligned with the stationary second valve cylindrical plate hole the New Mixture is blocked in at least one closed position and prevented from passing from the interior of the outer container into the interior of the rotatable applicator valve assembly; (D) a filter surrounding and/or encasing the at least one breakable Ampoule, and the filter is capable of preventing particulate material from passing from the outer container into the rotatable applicator valve assembly.

The filter can be at least one of in whole or in part foam, rubber, plastic, metal, screening, mesh, cotton, ceramic, fiberous material.

The applicator tip can be at least one of a brush, foam, sponge, a comb, a nozzle, a membrane permitting material transfer and/or diffusion, a tube or and/or series of tubes.

At least one mixing ball and/or solid object can be contained within the interior of the outer container.

The invention can also have at least one additional hair care product contained in the outer container and/or in at least one breakable Ampoule.

The external pressure and/or manual force and/or mixing can be generated by the act of squeezing and/or shaking the outer container with at least one human hand, finger or other area, and/or tool.

The open top can contain integral screw threads capable of mating with complimentary screw threads on the rotatable applicator valve to enable the rotatable applicator valve (or other device) to attach to the open top.

The valve open position and/or at least one dosed position can be designated and/or defined by at least one mechanical detent produced at the mating Surfaces of or between the rotatable first valve cylindrical plate and the stationary second valve cylindrical plate.

The Ampoule can further comprise of at least one of a breakable sealed glass container, a housing, at least one breakaway membrane, at least one puncturing and/or piercing edge and/or tooth to puncture said at least one breakaway membrane when said external pressure and/or manual force is applied to at least one location to the outer container.

A method for the second embodiment described above for applying a New Mixture to at least one Surface can comprise the following steps: A) squeezing the outer container to break an Ampoule contained within the outer container; B) squeezing and massaging the outer container to mix the second Component contained within the Ampoule with the first Component contained within the outer container to create the New Mixture; D) rotating a rotatable applicator valve assembly from a at least one closed position to an open position to allow the New Mixture to flow out of the rotatable applicator valve assembly into the applicator tip contained within the rotatable applicator valve assembly. D) squeezing the outer container to force the New Mixture out of the outer container into the applicator tip, and applying the New Mixture to at least one Surface and/or chosen hair area; E) if there is any New Mixture remaining in the outer container, rotating the rotatable applicator valve assembly from the open position to at least one closed position to prevent any New Mixture from exiting and/or leaking out of the rotatable applicator valve assembly.

A third embodiment of the invention can have a puncture flexible vessel (or Ampoule) and lance system. An integrated at least two Component system for applying a substance to at least one Surface can comprise: (A) an outer container made from a flexible material and having a closed bottom and sides and an open top, and the outer container can contain at least one first Component; (B) a rotatable applicator valve assembly comprising: a) an applicator subassembly for applying a New Mixture comprising: i) an applicator nozzle outer first end containing an applicator tip enabling the New Mixture to pass from the interior of the rotatable applicator valve assembly through the applicator tip to the exterior ambient; an applicator nozzle inner second end containing a rotatable first valve cylindrical plate containing a rotatable first valve cylindrical plate hole; b) a stationary second valve cylindrical plate attached to the open top while permitting rotation of the applicator subassembly, and the stationary second valve cylindrical plate can contain a second valve cylindrical plate hole, the rotatable first valve cylindrical plate being capable of rotating when the applicator subassembly is rotated, and the rotatable first valve cylindrical plate hole is capable of aligning at a first aligning angle with the stationary second valve cylindrical plate hole producing a valve open position to allow the New Mixture to pass from the interior of the outer container into the interior of the rotatable applicator valve assembly when external pressure and/or manual force is applied to the outer container and/or when pressure increases sufficiently within the interior of the outer container, and when the rotatable first valve cylindrical plate hole is not aligned with the stationary second valve cylindrical plate hole the New Mixture is blocked and prevented from passing from the interior of the outer container into the interior of the rotatable applicator valve assembly;

In this embodiment there are two possible second Component dispensing systems, the first second Component dispensing system being (C1) a flexible vessel with a rupture membrane affixed to one end, and the flexible vessel is contained within the outer container and affixed to the stationary second valve cylindrical plate, and the flexible vessel contains at least one second Component, whereupon the rupturing of the rupture membrane allows mixing of at east one second Component with at least one first Component to form the New Mixture, and the rupture membrane can be ruptured via the axial movement of a puncture lance caused to axially translate as a result of the rotation of the rotatable first valve cylindrical plate relative to the stationary second valve cylindrical plate using a lead screw and a rotation-arresting spline, and the rupturing occurring at a rupture position at a second aligning angle, and the second aligning angle being in at least one valve closed position to prevent material from entering the rotatable applicator valve assembly, and a mixing position at a third aligning angle between the rotatable first valve cylindrical plate relative to the stationary second valve cylindrical plate and the third aligning angle being in at least one valve closed position to prevent material from entering the rotatable applicator valve assembly and retraction of the puncture lance to allow free passage of at least one second Component from the flexible vessel into the interior of the outer container.

The second second Component dispensing system being (C2) a rigid containment and release vessel comprising an inner rotating cylinder with an inner rotating cylinder interior compartment and a shaft attachment to the rotatable first valve cylindrical plate and an outer stationary cylinder affixed to the stationary second valve cylindrical plate, and the outer stationary cylinder can contain at least two outer release slots; the inner rotating cylinder can contain at least two inner release slots; the rigid containment and release vessel can be contained below the stationary second valve cylindrical plate and within the the outer container; and the rigid containment and release vessel can contain within the inner rotating cylinder interior compartment at least one second Component, the rigid containment and release vessel being capable of being set to at least one closed position at a second aligning angle wherein at least one second Component contained within the inner rotating cylinder interior compartment cannot escape the inner rotating cylinder interior compartment and at least one first Component and/or the New Mixture contained within the outer container cannot enter the rotatable applicator valve assembly and the rigid containment and release vessel being capable of being set to a mixing position at a third aligning angle wherein at least two outer release slots and at least two inner release slots are aligned and at least one second Component can pass out of the inner rotating cylinder interior compartment and mix with at least one first Component contained within the outer container when external pressure and/or massaging and/or squeezing and/or manual force is applied to the outer container to create the New Mixture and the New Mixture is contained within the outer container and cannot enter the rotatable applicator valve assembly and the rigid containment and release vessel being capable of being set to a valve open position at a first aligning angle wherein at least two outer release slots and at least two inner release slots are aligned and at least one second Component can pass out of the inner rotating cylinder interior compartment and mix with at least one first Component contained within the outer container to create and/or continue to create the New Mixture and the New Mixture contained within the outer container and can enter the rotatable applicator valve assembly when external pressure and/or massaging and/or squeezing and/or manual force is applied to the outer container and/or when pressure increases sufficiently within the interior of the outer container.

The filter can be at least one of in whole or in part foam, rubber, plastic, metal, screening, mesh, cotton, ceramic, fiberous material.

The applicator tip can be at least one of a brush, foam, sponge, a comb, a nozzle, a membrane permitting material transfer and/or diffusion, a tube or and/or series of tubes.

The outer container can have at least one mixing ball and/or solid object with the interior of the outer container.

The invention can have at least one additional hair care product contained in the outer container and/or in or on at least one portion of the invention.

Mixing can occur through the application of external pressure and/or manual force and/or mixing can occur by the act of squeezing and/or shaking the outer container with at least one human hand.

The open top can contain integral screw threads capable of mating with complimentary screw threads on the rotatable applicator valve to enable the rotatable applicator valve to attach to the open top.

The valve open position and/or the rupture position can occur at a second aligning angle and/or mixing position at a third aligning angle can be designated and/or defined by at least one mechanical detent produced at the mating Surfaces of the rotatable first valve cylindrical plate and the stationary second valve cylindrical plate.

A method for the above described embodiment employing the first second Component dispensing system for applying a New Mixture to at least one Surface can comprise the following steps: A1) rotating a rotatable applicator valve assembly from at least one closed position to a rupture position at a second aligning angle to rupture a rupture membrane on a flexible vessel; B1) rotating the rotatable applicator valve assembly from the rupture position at a second aligning angle to a mixing position at a third aligning angle; C1) squeezing and/or massaging and/or shaking the outer container to mix the second Component contained within the flexible vessel with the first Component contained within the outer container to create the New Mixture; D1) rotating the rotatable applicator valve assembly from the mixing position at a third aligning angle to a valve open position at a first aligning angle to allow the New Mixture to flow out of the outer container and/or the rotatable applicator valve assembly into the applicator tip contained within the rotatable applicator valve assembly; E1) squeezing the outer container to force the New Mixture out of the outer container into the applicator tip, and applying the New Mixture to at least one Surface and/or chosen hair area; F1) if there is any New Mixture remaining in the outer container, rotating the rotatable applicator valve assembly from the valve open position at a first aligning angle to any closed position to prevent the New Mixture from exiting and/or leaking out of the rotatable applicator valve assembly; or employing the second second Component dispensing system for applying a New Mixture to at least one Surface, a method can comprise the following steps A2) rotating a rotatable applicator valve assembly from at least one closed position to a mixing position at a second aligning angle; B2) squeezing and/or massaging and/or shaking the outer container to mix the second Component contained within a rigid vessel with the first Component contained within the outer container to create the New Mixture; D2) rotating the rotatable applicator valve assembly from the mixing position at a third aligning angle to a valve open position at a first aligning angle to allow the New Mixture to flow out of the outer container and/or the rotatable applicator valve assembly into the applicator tip contained within the rotatable applicator valve assembly; E2) squeezing the outer container to force the New Mixture out of the outer container into the applicator tip, and applying the New Mixture to at least one Surface and/or chosen hair area; F2) if there is any New Mixture remaining in the outer container, rotating the rotatable applicator valve assembly from the valve open position at a first aligning angle to any closed position to prevent the New Mixture from exiting and/or leaking out of the rotatable applicator valve assembly.

Although preferred embodiments of the present invention have been described herein it will be understood by those skilled in the art that the present invention should not be limited to the described preferred embodiments. Rather, various changes and modifications can be made within the spirit and scope of the present invention.

All of the material in this patent document issue subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

COMPONENTS

Figure 1:
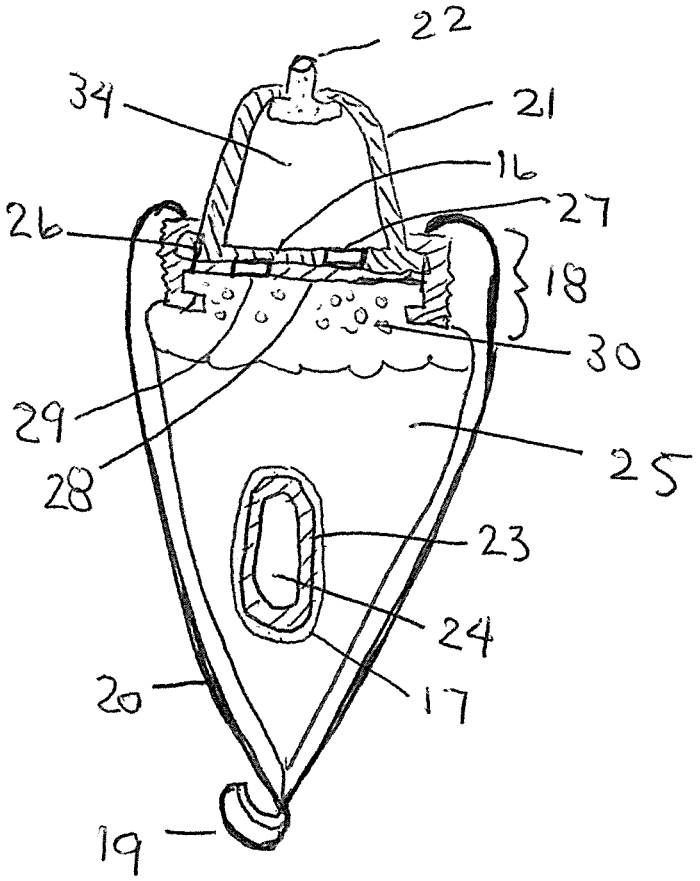
FIG. 1 shows a cross-sectional representation of one embodiment of the invention.

17 jacketed filter
18 open top contains integral screw threads
19 end
20 outer container
21 rotatable applicator valve assembly
22 applicator tip
23 ampoule
24 second component
25 first component
26 rotatable first valve cylindrical plate
27 rotatable first valve cylindrical plate hole
28 stationary second valve cylindrical plate
29 stationary second valve cylindrical plate hole
30 filter
31 at least one closed position
32 valve Open position
33 New Mixture
34 interior portion of the rotatable applicator valve assembly
40 rigid containment and release vessel
41 inner rotating cylinder
42 IRCslot1
43 IRCslot2
44 inner rotating cylinder interior compartment
45 shaft attachment
46 outer stationary cylinder
47 OSCslot1
48 OSCslot2
60 at least one closed position at a second aligning angle (top valve closed, cylinder valve closed)
61 mixing position at a third aligning angle (top valve closed, cylinder valve open)
62 valve open position at a first aligning angle (top valve open, cylinder valve open)
76 flexible vessel—not shown in drawings
78 rupture membrane—not shown in drawings
80 puncture lance—not shown in drawings
82 lead screw—not shown in drawings
84 rotation-arresting, spleen—not shown in drawings

DETAILED DESCRIPTION OF DRAWINGS

FIG. 1 shows a cross-sectional representation of one embodiment of the invention. Shown is the outer container 20, which can be a flexible container that can be pressed, manipulate, and/or compressed by squeezing manually. At the bottom of the outer container 20 is the end 19 and at the top is located the open top contains integral screw threads 18 where the rotatable applicator valve assembly 21 attaches. Within the outer container 20 is located the first component 25 and within the first Component 25 is the Ampoule 23 in which is contained second Component 24. When the outer container 20 is manually compressed it is possible to break and shatter the Ampoule 23, thus releasing the second Component 24 into the colorant 25. When squeezing by hand the outer container 20 the second Component 24 is mixed into the colorant 25 to produce a New Mixture 33, not shown but described as the result of this mixing process. The rotatable applicator valve assembly 21 screws into and is locked within the open top contains integral screw threads 18. The rotatable applicator valve assembly 21 is composed of a rotatable first valve cylindrical plate 26 containing a rotatable first valve cylindrical plate hole 27 and a stationary second valve cylindrical plate 28 containing a stationary second valve cylindrical plate hole 29. At the top end of the rotatable applicator valve assembly 21 is the applicator tip 22 from which the New Mixture 33 emanates and is selectively applied to desired locations to color hair. Also show is filter 30, which prevents particulate material from the breaking of Ampoule 23 from entering the rotatable applicator valve assembly 21.

Figure 2A:
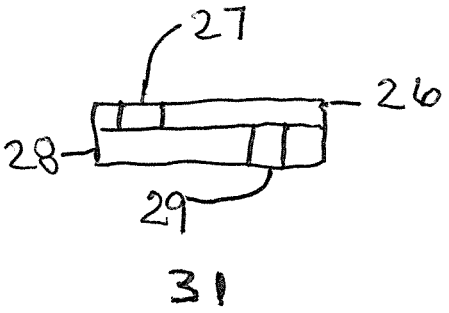
FIG. 2A shows a cross-sectional representation of a valve in a closed position.
Figure 2B:
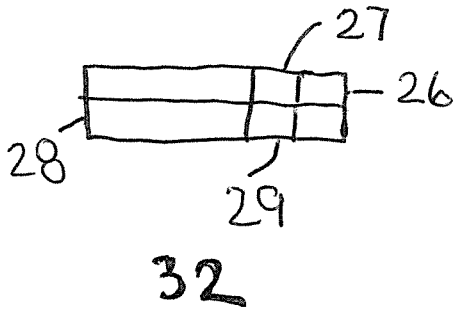
FIG. 2B shows a cross-sectional representation of the same valve of FIG. 2A in an open position.

FIG. 2 shows a cross-sectional representation of a valve in at least one closed position 31 and the same valve in an valve open position 32. At least one closed position 31 shows the rotatable first valve cylindrical plate hole 27 located in the rotatable first valve cylindrical plate 26 misaligned with the stationary second valve cylindrical plate hole 29 located in the stationary second valve cylindrical plate 28, thus preventing New Mixture 33 from entering the interior portion of the rotatable applicator valve assembly 34 depicted in FIG. 1. This is a mirror image of the valve alignment position shown in FIG. 1, and shown for example of the valve theory operation only. Valve open position 32 shows the rotatable first valve cylindrical plate hole 27 located in the rotatable first valve cylindrical plate 26 aligned with the stationary second valve cylindrical plate hole 29 located in the stationary second valve cylindrical plate 28, thus allowing New Mixture 33 to enter and fill the interior portion of the rotatable applicator valve assembly 34, and subsequently saturate and exit the applicator tip 22 for application to selective portions of hair for coloring with the New Mixture 33. There can also be detents (not shown) which can designate and/or define the various open and/or closed and/or other positions in other embodiments, and these detents can be produced at the mating Surfaces of the rotatable first valve cylindrical plate 26 and said stationary second valve cylindrical plate 28.

Figure 3:
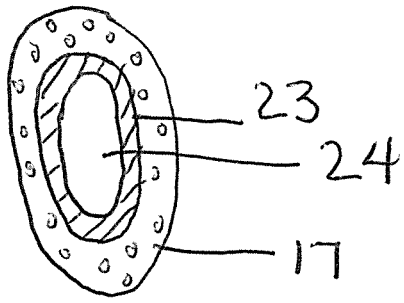
FIG. 3 shows a cross-sectional representation of one embodiment of an Ampoule with a jacketed filter.

FIG. 3 shows a cross-sectional representation of one embodiment of a Ampoule with a jacketed filter. Shown is the Ampoule 23 filled with second Component 24 as could be depicted in FIG. 1. However in this embodiment, the filter 30 of FIG. 1 is omitted and replaced with a jacketed filter 17 located around the Ampoule 23.

Figure 4A:
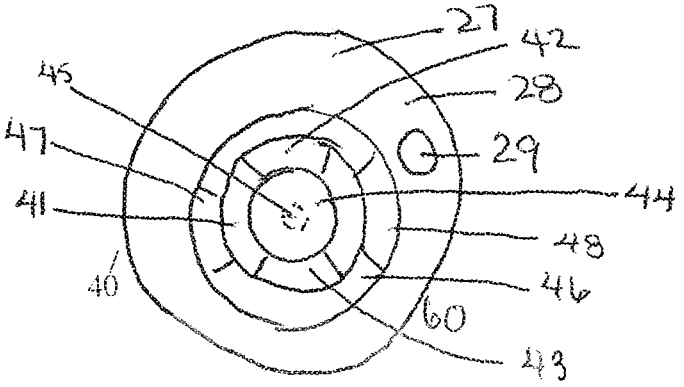
FIG. 4A shows a schematic representation of a bottom view of the rigid containment release vessel in the closed position.
Figure 4B:
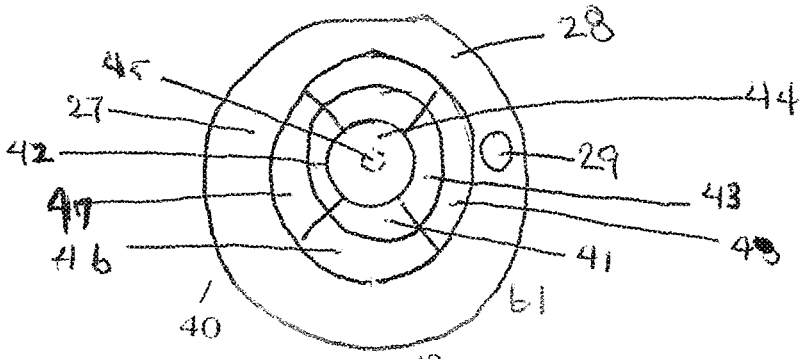
FIG. 4B shows a schematic representation of a bottom view of the rigid containment release vessel in the mixing position.
Figure 4C:
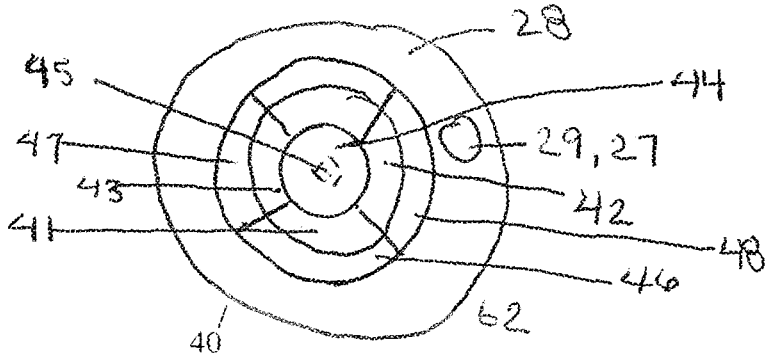
FIG. 4C shows a schematic representation of a bottom view of the rigid containment release vessel in the open position.

FIG. 4 shows a schematic representation of a bottom view of the rigid containment release vessel 40 in at least one closed position at a second aligning angle 60 or the closed position, the mixing position at a third aligning angle 61 or the mixing position, and the valve open position at a first aligning angle 62 or the open position.

A rigid containment and release vessel 40 is constructed from an inner rotating cylinder 41 and an outer stationary cylinder 46. The outer stationary cylinder 46 is connected to stationary second valve cylindrical plate 28 and remains in a fixed position relative to the outer container 20 shown in FIG. 1 but the outer container 20 is not shown in FIG. 4 for clarity. The inner rotating cylinder 41 is connected via shaft attachment 45 to rotatable first valve cylindrical plate 26. Rotatable first valve cylindrical plate 26 is located directly behind stationary second valve cylindrical plate 28. Rotatable first valve cylindrical plate 26 has rotatable first valve cylindrical plate hole 27 which can either align or misalign with stationary second valve cylindrical plate hole 29 located on the stationary second valve cylindrical plate 28.

Inner rotating cylinder 41 has within the cylinder wall a pair of slots IRCslot1 42 and IRCslot2 43, and these slots can either align or misalign with slots OSCslot1 47 and OSCslot2 48 located within the cylinder wall of outer stationary cylinder 46. When the slots are aligned, the second Component 24 can pass through the slots and mix with first Component 25 located within outer container 20. In this embodiment there are two simultaneous valve functions occurring: the passage or blockage of material between the inner rotating cylinder interior compartment 44 and the outer container 20 (depending on the orientation of slots IRCslot1 42 and IRCslot2 43 with slots OSCslot1 47 and OSCslot2 43) and the passage or blockage of material between the inner compartment 20 and the rotatable applicator valve assembly 21 (depending upon the relative positions of the rotatable first valve cylindrical plate hole 27 and the stationary second valve cylindrical plate hole 29. Both valves are operated simultaneously via the movement of rotatable first valve cylindrical plate 26 relative to stationary second valve cylindrical plate 28. The three valve positions are elucidated as follows:

At least one closed position at a second aligning angle 60, which could be considered the shipping position, shows slots IRCslot1 42 and IRCslot2 43 located on inner rotating cylinder 41 in a misaligned position relative to slots OSCslot1 47 and OSCslot2 48 located on outer stationary cylinder 46, thus keeping second Component 24 trapped within the inner rotating cylinder interior compartment 44. Simultaneously, rotatable first valve cylindrical plate hole 27 on rotatable first valve cylindrical plate 26 is misaligned with stationary second valve cylindrical plate hole 29 located on stationary second valve cylindrical plate 28, thus preventing any material or New Mixture 33 from entering the rotatable applicator valve assembly 21.

Next is shown mixing position at a third aligning angle 61, where IRCslot1 42 is aligned with OSCslot1 47 and IRCslot2 43 is aligned with OSCslot2 48 and thus second Component 24 can now pass freely between the slots and can mix with first Component 25 to create New Mixture 33, which can occur via the manual action of or force applied and/or squeezing and/or shaking of the outer container 20. During this mixing function there is misalignment between rotatable first valve cylindrical plate hole 27 and stationary second valve cylindrical plate hole 29, and thus no New Mixture 33 can pass through these two holes and enter the rotatable applicator valve assembly 21.

Once mixing is complete, the rotatable applicator valve assembly 21 can be rotated to valve open position at a first aligning angle 62. In this position, because the rotatable first valve cylindrical plate 26 has rotated 180 degrees, IRCslot1 42 is aligned with OSCslot2 48 and IRCslot2 43 is aligned with OSCslot1 47, so the inner rotating cylinder interior compartment 44 is still open and residual concentration of the second Component 24 can continue to me mixed with the first Component 25 and New Mixture 33 can fill outer container 20. And in this position rotatable first valve cylindrical plate hole 27 is aligned with stationary second valve cylindrical plate hole 29 and New Mixture can pass from the outer container 20 into the rotatable applicator valve assembly 21, the applicator tip 22, and New Mixture 33 can be applied to a Surface which can be hair or any other Surface.

DEFINITIONS

Ampoule—a sealed glass or plastic capsule or vessel containing a liquid, usually of certain measured quantity ready for use.

Component: A component can be at least one of in whole or in part a solid, liquid, gas, suspension, colorant, hair colorant, dye, ink, fluorescing material, adhesive, cement, glue, plastic, sculpting material to build up a surface three-dimensionally, plaster, rubber and/or synthetic rubber, a cleaning solution, medication, medicine, mixture, element, compound, formula, a catalyst, hydrogen peroxide, ammonia, a binder, accelerant, coagulant, and/or other known or unknown catalyst.

At least one first component: can be at least one component.

At least one second component: can be at least one component.

New Mixture: A new mixture can be a coloring mixture, a hair coloring mixture, semi-permanent hair coloring mixture, permanent hair coloring mixture, at least one first component mixed with at least one second component.

Surface: At least one surface is hair and/or a portion thereof, any surface and/or a portion thereof upon which a mixture and/or new mixture and/or component and/or material can be applied Substance: A substance is at least one of at least one component, a mixture, a new mixture.

As used herein, the term "and/or," when used in a list of two or more items, means that any one of the listed items can be employed by itself, or any combination of two or more of the listed items can be employed. For example, if a device is described as containing components A, B, and/or C, the composition can contain A alone; B alone; C alone; A and B in combination; A and C in combination; B and C in combination; or A, B, and C in combination.

The invention claimed is:

1. An integrated at least two component system for applying a substance to at least one surface comprising:

(A) an outer container made from a flexible material and having a closed bottom and sides and an open top, the said outer container containing at least one first component, (B) at least one breakable ampoule contained within the said outer container; wherein the said at least one breakable ampoule contains at least one second component, whereupon the rupturing and/or puncturing and/or breaking and/or crushing and/or squeezing of said at least one breakable ampoule allows mixing of said at least one first component with said at least one second component to form a new mixture; and (C) a rotatable applicator valve assembly comprising:

a) an applicator subassembly for applying said new mixture comprising:

i) an applicator nozzle outer first end containing an applicator tip enabling said new mixture to pass from the interior of said rotatable applicator valve assembly through said applicator tip to the exterior ambient;

ii) an applicator nozzle inner second end containing a rotatable first valve cylindrical plate containing a rotatable first valve cylindrical plate hole;

b) a stationary second valve cylindrical plate attached to said open top while permitting rotation of said applicator subassembly, said stationary second valve cylindrical plate containing a stationary second valve cylindrical plate hole, said rotatable first valve cylindrical plate being capable of rotating when said applicator subassembly is rotated, said rotatable first valve cylindrical plate hole capable of aligning at a first aligning angle with said stationary second valve cylindrical plate hole producing a valve open position and allowing said new mixture to pass from the interior of said outer container into said interior of said rotatable applicator valve assembly when said rotatable applicator valve assembly is rotated to an open position and/or when external pressure and/or manual force is applied to said outer container and/or when pressure increases sufficiently within the interior of said outer container, and when said rotatable first valve cylindrical plate hole is not aligned with said stationary second valve cylindrical plate hole said new mixture is blocked in at least one closed position and prevented from passing from the interior of said outer container into said interior of said rotatable applicator valve assembly.

2. The invention of claim 1 further comprising a filter contained within said outer container or said rotatable applicator and valve assembly, or a filter surrounding and/or encasing said at least one breakable ampoule, said filter capable of preventing particulate material from passing from said outer container into said rotatable applicator valve assembly, and wherein said filter is at least one of in whole or in part foam, rubber, plastic, metal, screening, mesh, ceramic, cotton and/or fiberous material.

3. The invention of claim 1 wherein said applicator tip is at least one of a brush, foam, sponge, a comb, hose, a nozzle, a membrane permitting material transfer and/or diffusion, a tube or series of tubes.

4. The invention of claim 1 further comprising at least one mixing ball and/or solid object within the interior of said outer container.

5. The invention of claim 1 further comprising at least one additional hair care product contained in said outer container and/or in at least one breakable ampoule.

6. The invention of claim 1 wherein said external pressure and/or manual force and/or said mixing is generated by the act of squeezing and/or shaking said outer container with at least one human hand.

7. The invention of claim 1 wherein said open top contains integral screw threads capable of mating with complimentary screw threads on said rotatable applicator valve assembly to enable said rotatable applicator valve to attach to said open top.

8. The invention of claim 1 wherein said valve open position and/or said at least one closed position are designated and/or defined by at least one mechanical detent decent produced at the mating surfaces of said rotatable first valve cylindrical plate and said stationary second valve cylindrical plate.

9. The invention of claim 1 wherein said ampoule further comprises of at least one of a breakable sealed glass container, a housing, at least one breakaway membrane, at least one puncturing and/or piercing edge and/or tooth to puncture said at least one breakaway membrane when said external pressure and/or manual force is applied to at least one location to said outer container.

10. A method for applying a new mixture to at least one surface comprising at least one of the following steps:

A)

1) squeezing the outer container to break an ampoule contained within said outer container;

2) squeezing and massaging said outer container to mix the second component contained within said ampoule with the first component contained within said outer container to create said new mixture;

3) rotating a rotatable applicator valve assembly from at least one closed position to an open position to allow said new mixture to flow out of said rotatable applicator valve assembly into the applicator tip contained within said rotatable applicator valve assembly;

4) squeezing said outer container to force said new mixture out of said outer container into said applicator tip, and applying said new mixture to chosen surface or hair area;

5) if there is any said new mixture remaining in said outer container, rotating said rotatable applicator valve assembly from said open position to said at least one closed position to prevent said new mixture from exiting and/or leaking out of said rotatable applicator valve assembly or

B)

1) squeezing the outer container to break an ampoule contained within said outer container;

2) squeezing and massaging said outer container to mix the second component contained within said ampoule with the first component contained within said outer container to create said new mixture:

3) rotating a rotatable applicator valve assembly from at least one closed position to an open position to allow said new mixture to flow out of said rotatable applicator valve assembly into the applicator tip contained within said rotatable applicator valve assembly;

4) squeezing said outer container to force said new mixture out of said outer container into said applicator tip, and applying said new mixture to at least one surface and/or chosen hair area;

5) if there is any said new mixture remaining in said outer container, rotating said rotatable applicator valve assembly from said open position to said at least one closed position to prevent said new mixture from exiting and/or leaking out of said rotatable applicator valve assembly;

or

C)

1) rotating a rotatable applicator valve assembly from at least one closed position to a rupture position at a second aligning angle to puncture a flexible vessel contained within an outer container, the outer container containing a first component and the flexible vessel containing a second component;

2) rotating said rotatable applicator valve assembly from said rupture position at a second aligning angle to a mixing position at a third aligning angle;

3) squeezing and/or massaging and/or shaking said outer container to mix the second component contained within said flexible vessel with the first component contained within said outer container to create said new mixture;

4) rotating said rotatable applicator valve assembly from said mixing position at a third aligning angle to a valve open position at a first aligning angle to allow said new mixture to flow out of said outer container and/or said rotatable applicator valve assembly into the applicator tip contained within said rotatable applicator valve assembly;

5) squeezing said outer container to force said new mixture out of said outer container into said applicator tip, and applying said new mixture to at least one surface and/or chosen hair area;

6) if there is any said new mixture remaining in said outer container, rotating said rotatable applicator valve assembly from said valve open position at a first aligning angle to any closed position to prevent said new mixture from exiting and/or leaking out of said rotatable applicator valve assembly;

or

D)

1) rotating a rotatable applicator valve assembly from at least one closed position to a mixing position at a second aligning angle;

2) squeezing and/or massaging and/or shaking an outer container to mix a second component contained within a rigid vessel with a first component contained within said outer container to create a new mixture;

3) rotating said rotatable applicator valve assembly from said mixing position at a third aligning angle to a valve open position at a first aligning angle to allow said new mixture to flow out of said outer container and/or said rotatable applicator valve assembly into an applicator tip contained within said rotatable applicator valve assembly;

4) squeezing said outer container to force said new mixture out of said outer container into said applicator tip, and applying said new mixture to at least one surface and/or chosen hair area;

5) if there is any said new mixture remaining in said outer container, rotating said rotatable applicator valve assembly from said valve open position at a first aligning angle to any closed position to prevent said new mixture from exiting and/or leaking out of said rotatable applicator valve assembly.

11. An integrated at least two component system for applying a substance to at least one surface comprising:

(A) an outer container made from a flexible material and having a closed bottom and sides and an open top, the said outer container containing at least one first component;

(B) a rotatable applicator valve assembly comprising:

a) an applicator subassembly for applying a new mixture comprising:

i) an applicator nozzle outer first end containing an applicator tip enabling said new mixture to pass from the interior of said rotatable applicator valve assembly through said applicator tip to the exterior ambient;

ii) an applicator nozzle inner second end containing a rotatable first valve cylindrical plate containing a rotatable first valve cylindrical plate hole;

b) a stationary second valve cylindrical plate attached to said open top while permitting rotation of said applicator subassembly, said stationary second valve cylindrical plate containing a second valve cylindrical plate hole, said rotatable first valve cylindrical plate being capable of rotating when said applicator subassembly is rotated, said rotatable first valve cylindrical plate hole capable of aligning at a first aligning angle with said stationary second valve cylindrical plate hole producing a valve open position to allow said new mixture to pass from the interior of said outer container into said interior of said rotatable applicator valve assembly when said rotatable applicator valve assembly is rotated to an open position and/or when external pressure and/or manual force is applied to said outer container and/or when pressure increases sufficiently within the interior of said outer container, and when said rotatable first valve cylindrical plate hole is not aligned with said stationary second valve cylindrical plate hole said new mixture is blocked and prevented from passing from the interior of said outer container into said interior of said rotatable applicator valve assembly; and (C) a vessel comprising:

(C1) a flexible vessel contained within the said outer container and affixed to said stationary second valve cylindrical plate, said flexible vessel containing at least one second component, whereupon the rupturing of said flexible vessel allows mixing of said at least one second component with said at least one first component to form said new mixture, said rupturing of said flexible vessel occurring at a rupture position at a second aligning angle of said rotatable applicator valve assembly said second aligning angle being in at least one valve closed position to prevent material from entering said rotatable applicator valve assembly, and a mixing position at a third aligning angle between said rotatable first valve cylindrical plate relative to said stationary second valve cylindrical plate of said rotatable applicator valve assembly and said third aligning angle being in at least one valve closed position to prevent material from entering said rotatable applicator valve assembly and to allow free passage of said at least one second component from said flexible vessel into said interior of said outer container, or (C2) a rigid containment and release vessel comprising an inner rotating cylinder with an inner rotating cylinder interior compartment and a shaft attachment to said rotatable first valve cylindrical plate and an outer stationary cylinder affixed to said stationary second valve cylindrical plate, said outer stationary cylinder containing at least two outer release slots;

said inner rotating cylinder containing at least two inner release slots;

said rigid containment and release vessel contained below said stationary second valve cylindrical plate and within the said outer container, said rigid containment and release vessel containing within said inner rotating cylinder interior compartment at least one second component, said rigid containment and release vessel being capable of being set to at least one closed position at a second aligning angle wherein said at least one second component contained within said inner rotating cylinder interior compartment cannot escape said inner rotating cylinder interior compartment and said at least one first component and/or said new mixture contained within said outer container cannot enter said rotatable applicator valve assembly, and said rigid containment and release vessel being capable of being set to a mixing position at a third aligning angle wherein said at least two outer release slots and said at least two inner release slots are aligned and at least one second component can pass out of said inner rotating cylinder interior compartment and mix with said at least one first component contained within said outer container when external pressure and/or massaging and/or squeezing and/or shaking and/or manual force is applied to said outer container to create said new mixture and said new mixture is contained within said outer container and cannot enter said rotatable applicator valve assembly, and said rigid containment and release vessel being capable of being set to a valve open position at a first aligning angle wherein said at least two outer release slots and said at least two inner release slots are aligned and at least one second component can pass out of said inner rotating cylinder interior compartment and mix with at least one first component contained within said outer container to create and/or continue to create said new mixture and said new mixture contained within said outer container and can enter said rotatable applicator valve assembly when external pressure and/or massaging and/or squeezing and/or manual force is applied to said outer container and/or when pressure increases sufficiently within the interior of said outer container.

12. The invention of claim 11 further comprising a filter contained within said outer container or said rotatable applicator and valve assembly, or a filter surrounding and/or encasing said at least one vessel, said filter capable of preventing particulate material from passing from said outer container into said rotatable applicator valve assembly, and wherein said filter is at least one of in whole or in part foam, rubber, plastic, metal, screening, mesh, cotton, ceramic, fiberous material.

13. The invention of claim 11 wherein said applicator tip is at least one of a brush, foam, sponge, a comb, a nozzle, a membrane permitting material transfer and/or diffusion, a tube or and/or series of tubes.

14. The invention of claim 11 further comprising at least one mixing ball and/or solid object with the interior or of said outer container.

15. The invention of claim 11 further comprising at least one additional hair care product contained in said outer container and/or in at least one portion of said invention of claim 11.

16. The invention of claim 11 wherein said external pressure and/or manual force and/or said mixing is generated by the act of squeezing and/or shaking said outer container with at least one human hand.

17. The invention of claim 11 wherein said open top contains integral screw threads capable of mating with complimentary screw threads on said rotatable applicator valve to enable said rotatable applicator valve to attach to said open top.

18. The invention of claim 11 wherein said valve open position and/or said rupture position at a second aligning angle and/or said mixing position at a third aligning angle are designated and/or defined by at least one mechanical detent produced at the mating surfaces of said rotatable first valve cylindrical plate and said stationary second valve cylindrical plate.

* * * * *